US010849465B2

(12) United States Patent
Zeanah

(10) Patent No.: US 10,849,465 B2
(45) Date of Patent: Dec. 1, 2020

(54) PLUMBING FIXTURE COVER

(71) Applicant: American Accessories International LLC, Knoxville, TN (US)

(72) Inventor: David Zeanah, Knoxville, TN (US)

(73) Assignee: AMERICAN ACCESSORIES INTERNATIONAL LLC, Knoxville, TN (US)

( * ) Notice: Subject to any disclaimer, the term of this patent is extended or adjusted under 35 U.S.C. 154(b) by 0 days.

(21) Appl. No.: 16/141,352

(22) Filed: Sep. 25, 2018

(65) Prior Publication Data

US 2019/0090696 A1 Mar. 28, 2019

Related U.S. Application Data

(60) Provisional application No. 62/562,616, filed on Sep. 25, 2017.

(51) Int. Cl.
*A47K 3/00* (2006.01)
*E03C 1/04* (2006.01)

(52) U.S. Cl.
CPC ..... *A47K 3/005* (2013.01); *E03C 1/0404* (2013.01)

(58) Field of Classification Search
CPC ..... A47K 3/005
USPC ..... 4/559
See application file for complete search history.

(56) References Cited

U.S. PATENT DOCUMENTS 5,125,577 A * 6/1992 Frankel ..... E03C 1/02 239/211
2011/0023979 A1* 2/2011 Henderson ..... A47K 3/005 137/377

* cited by examiner

*Primary Examiner* — Lauren A Crane
(74) *Attorney, Agent, or Firm* — Troutman Pepper Hamilton Sanders LLP; Ryan A. Schneider; Christopher C. Close, Jr.

(57) ABSTRACT

A device comprising: a body, the body comprises an interior and an exterior, the interior of the body defining a space configured to accommodate at least a portion of a plumbing fixture and the exterior of the body forming a decorative display; and a first flap attached to the body of the device and configured to attach the device to a plumbing fixture.

18 Claims, 9 Drawing Sheets

PLUMBING FIXTURE COVER

CROSS-REFERENCE TO RELATED APPLICATION

This Application claims the benefit, under 35 U.S.C. § 119(e), of U.S. Provisional Patent Application No. 62/562,616, filed Sep. 25, 2017, the contents of which are hereby incorporated by reference herein in their entirety as if fully set forth below.

TECHNICAL FIELD

The various embodiments of the disclosure relate generally to devices, methods, and systems for covering plumbing fixtures or spouts.

BACKGROUND

Covers for plumbing fixtures may be used to impart an aesthetic appearance that is not inherent in the fixture. In this manner, these devices can make bath time or hand washing more fun, especially for kids and younger children. Ideally the covers can be attached and detached easily without requiring a complex mechanism since managing children is already a difficult task. While some covers include complex tightening mechanisms to prevent or attempt to prevent removal, these tightening mechanisms can prove to be misleading. In a wet and soapy environment, it can still be easy for such covers to slip off the plumbing fixture. Of utmost importance is a cover that can be attached easily, even while a plumbing fixture is in use.

BRIEF SUMMARY

Embodiments of the present disclosure can include covers for plumbing fixtures including bath faucets or spouts. Embodiments of the disclosure may be made from one or more materials, including a combination of materials. A preferred embodiment can include a device configured to cover at least part of a plumbing fixture. The device may include a body and a first flap. The body may include an interior and an exterior. The interior of the body may define a space configured to accommodate at least a portion of a plumbing fixture. The exterior of the body may form a decorative display. The flap may serve as a positioning mechanism for the device. Throughout this disclosure the term positioning mechanism and flap may be used interchangeably. The first flap may be attached to the body of the device and may be configured to attach the device to a plumbing fixture. In some embodiments, the device may include a second flap. The second flap may be attached to the body of the device and configured to attach the device to a plumbing fixture. In some embodiments, the first and second flap are positioned on opposite sides of the interior of the device. The width of the first flap and the width of the second flap may each be less than half a width of the body. In some embodiments, the first and second flap may be attached to the interior of the body. The first flap may curve inwardly into the space and wherein the first flap is configured to flex when applying the device to a plumbing fixture. The first flap may be configured to engage an underside of a plumbing fixture.

In some embodiments, the body may include a first opening. The first opening may be positioned to accommodate a spout of a plumbing fixture. In some embodiments, the body may also include a second opening. The second opening may be positioned to accommodate a shower diverter on a topside of a plumbing fixture. According to some embodiments, the body may comprise a polymer. The polymer may be an elastomer, a resin, a gel, a copolymer, a thermoplastic, and/or any combination thereof.

According to some embodiments, the first and second flap may be configured such that applying a force while attaching the device to the plumbing fixture causes the first and second flap to reversibly flex away from one another. The first and second flap may also be configured to engage part of the plumbing fixture such that applying a force while removing the device causes the first and second flap to flex toward one another.

In certain embodiments, the body of the device is flexible. The body of the device may be elastic. The body of the device may be comprised of a polymer. The polymer may be an elastomer, a resin, a gel, a copolymer, a thermoplastic, and/or any combination thereof. Additionally, the polymer can further include a dispersed phase selected from the following group: a second polymer, a gas, a liquid, and a solid. According to some embodiments, the first and second flaps are attached to the interior of the body. The first flap curves inwardly into the space and wherein the first flap is configured to flex when applying the device to a plumbing fixture. The first flap may be further configured to engage an underside of a plumbing fixture. In some embodiments, the body may include a first opening positioned to accommodate a spout of a plumbing fixture. The body may further include a second opening positioned to accommodate a shower diverter on a topside of a plumbing fixture. In some embodiments, the first and second opening may extend less than half the length of the device. In certain embodiments, the first and second opening are collinear.

Another embodiment of the present disclosure may include a device having a flexible body and a first flap. The flexible body may include an interior and an exterior. The interior of the flexible body may be configured to house at least a portion of a plumbing fixture. The exterior of the flexible body may form a decorative display. The first flap may be attached to the flexible body of the device. The first flap may be configured to attach at least a portion of a plumbing fixture to the device.

Some embodiments may include a second flap attached to the flexible body of the device. The second flap may be configured to attach at least a portion of a plumbing fixture to the device. In some embodiments, the first and second flaps are positioned on opposite sides of the interior of the device. The flexible body may include a second opening positioned to accommodate a shower diverter on a topside of a plumbing fixture. The flexible body may be elastic. The flexible body may be comprised of a polymer. The polymer may be an elastomer, a resin, a gel, a copolymer, a thermoplastic, and/or any combination thereof. Additionally, the polymer can further include a dispersed phase selected from the following group: a second polymer, a gas, a liquid, and a solid.

Another embodiment of the disclosure includes a method of attaching a device configured to cover part of a plumbing fixture to the plumbing fixture that includes positioning the device over the plumbing fixture and applying a force to the device. In certain embodiments, the method can further include adjusting the device to engage part of the plumbing fixture.

In an embodiment of the disclosure, the body can also include an exterior, such that the distance between the interior and the exterior defines a thickness. In certain embodiments, the thickness is substantially the same for over about 50% of the body such as over about 60%, about 70%, about 80%, or about 90%.

Embodiments of the disclosure that include an exterior can include a feature on the exterior that is not present on the interior. In certain embodiments, this feature can be a child friendly design or a facial characteristic such as an eye, a mouth, a nose.

Certain embodiments of the disclosure may provide the body in a form of a decorative display, including an animal. In some embodiments, the animal is an elephant that includes a trunk. In an embodiment of the disclosure, the plumbing fixture can be a faucet and the faucet can be a bath faucet that includes a shower diverter.

An embodiment of the disclosure may include a device providing a right and a bottom. The device includes a positioning mechanism attached on the right in proximity of the bottom of the device, and the positioning mechanism can be configured to engage a plumbing fixture while the device is in use. Certain devices may also provide a top configured so that at least a portion of the top is connected to the right. In some embodiments, the top includes two apertures that are less than half the length of the device. In certain embodiments, the bottom can be at least partially open along the length of the device, the back can be at least partially open along the height of the device, or the back and the bottom can be at least partially open along the device. Some devices may further include a second positioning mechanism attached on a left in proximity of the bottom of the device such that both positioning mechanisms are configured to engage a plumbing fixture while the device is in use.

Embodiments of the disclosure can also include a method of attaching a device that includes a body and a positioning mechanism by pressing the device against a bathtub faucet to provide a force causing the positioning mechanism to flex. In certain embodiments, the body defines a space configured to accommodate a plumbing fixture. In some embodiments, the device also includes a second positioning mechanism and each positioning mechanism is attached to the body. Additionally, each positioning mechanism extends into the space configured to accommodate the pluming fixture.

DETAILED DESCRIPTION

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Many suitable components that would perform the same or similar functions as components described herein are intended to be embraced within the scope of the disclosed electronic devices and methods. Such other components not described herein may include, but are not limited to, for example, components developed after development of the disclosed technology.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Ranges can be expressed herein as from "about" or "approximately" one value and/or to "about" or "approximately" another value.

As used herein, "comprising" or "providing" or "including" are meant to indicate that at least the named compound, element, characteristic or method step is present. However, using this term does not exclude the presence of other compounds, elements, characteristics or method steps, even if the other such compounds, elements, characteristics or method steps have the same function.

Further, the mention of one or more method steps does not preclude the presence of additional method steps or intervening steps between those steps expressly identified. Similarly, the mention of one or more components in a device or system does not preclude the presence of additional components or interactions between the components.

Reference will now be made in detail to exemplary embodiments of the disclosed technology, examples of which are illustrated in the accompanying drawings and disclosed herein. Wherever convenient, the same references numbers will be used throughout the drawings to refer to the same or like parts.

Figure 1:
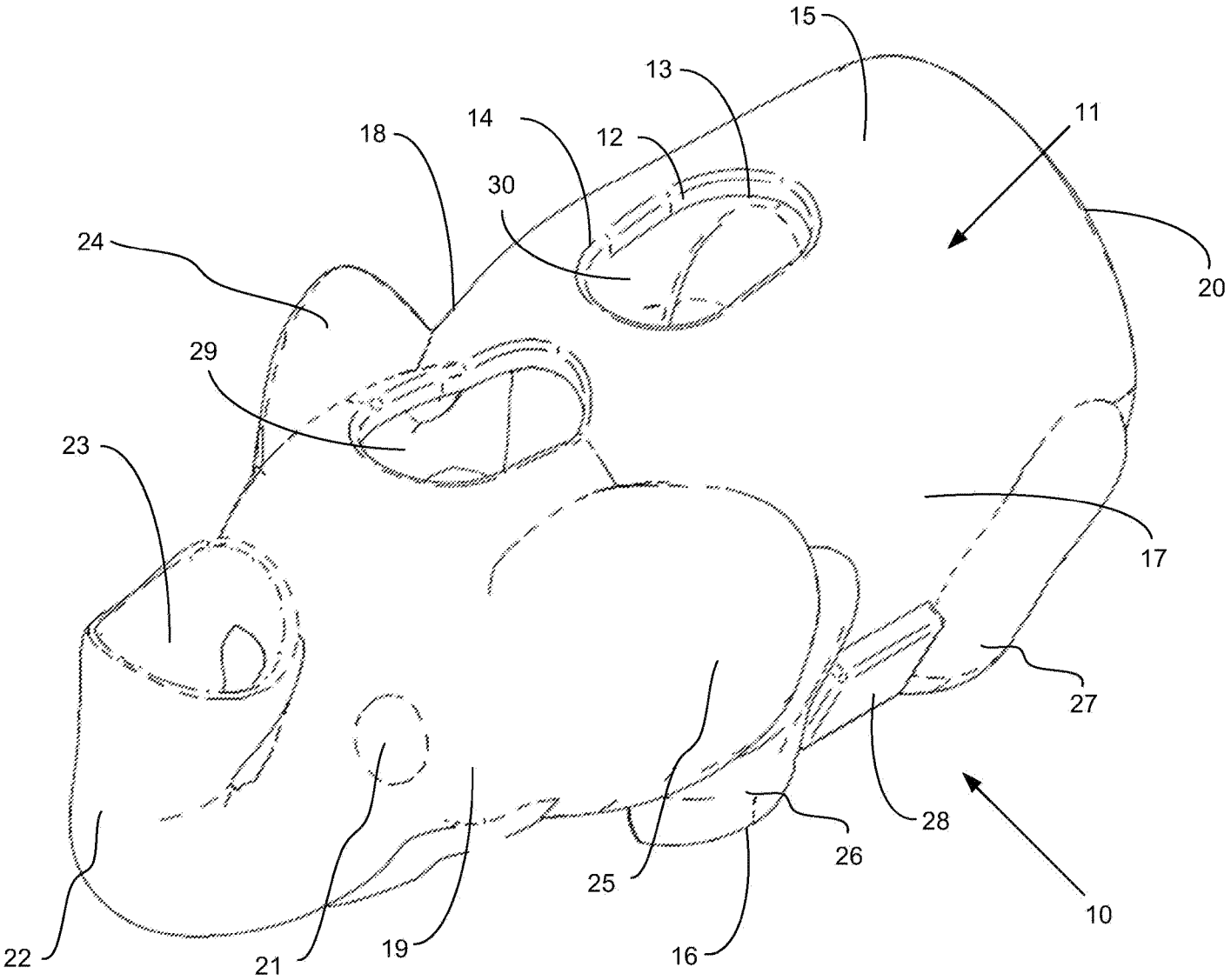
FIG. 1 illustrates an upper perspective view of a device in accordance with an exemplary embodiment of the disclosure.

FIG. 1 provides an example embodiment illustrating a device 10 that includes a body 11 configured to surround or cover part of a plumbing fixture. The body 11 includes an exterior surface 14 and an interior surface 13. The interior surface 13 may accommodate at least a portion of a plumbing fixture. The exterior surface 14 may form a decorative display, for instance, the appearance of an elephant. The body 11 provides a thickness 12 which is defined as the distance between an interior surface 13 of the body and an exterior surface 14 of the body. The thickness can be adjusted to alter dissipation of impact forces otherwise referred to as softness or cushion or to alter rigidity of the body or to alter both dissipation and rigidity. In the embodiment shown, the body 11 is rigid enough to keep its shape when not in use, but flexible enough to cover different sized plumbing fixtures. The body 11 includes a top 15, a bottom 16, a right 17, a left 18, a front 19 and a back 20. The body 11 bears the appearance of an elephant including a front 19 with a design feature 21 such as an eye, a trunk 22 and an opening 23 in the trunk; a left 18 with an ear 24; a right 17 with an ear 25, two legs 26 and 27 and an area for a first flap 28; and a top 15 with two oval-shaped openings 29 and 30 that extend less than half the length of the body. The body 11 can be made of many different materials including plastics and polymers that are suited to wet or humid environments.

The area 28 for the first flap is situated near the bottom 16 on the right 17 and the first flap on the right provides an extension, allowing the device 10 to attach to the plumbing fixture. Though not shown, the bottom 16 is at least partially open, providing an area to accommodate insertion of a plumbing fixture. Similarly, the back 20 is at least partially open. Together these open areas accommodate sliding the body 11 onto a plumbing fixture or pressing the body 11 against a plumbing fixture to cover part of the plumbing fixture. During the step of sliding onto a plumbing fixture or pressing on a plumbing fixture, the first flap flexes away from the plumbing fixture and/or may curve inwardly to allow access to the device interior while also creating a frictional interaction.

Figure 2B:
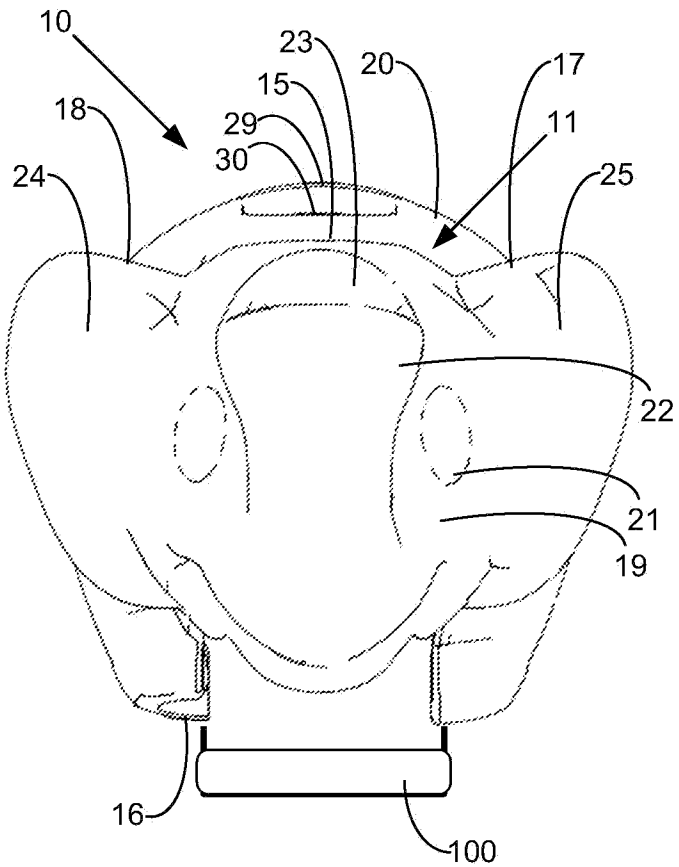
FIG. 2B illustrates a frontal view of a device in use with a faucet in accordance with exemplary embodiments of the disclosure
Figure 2A:
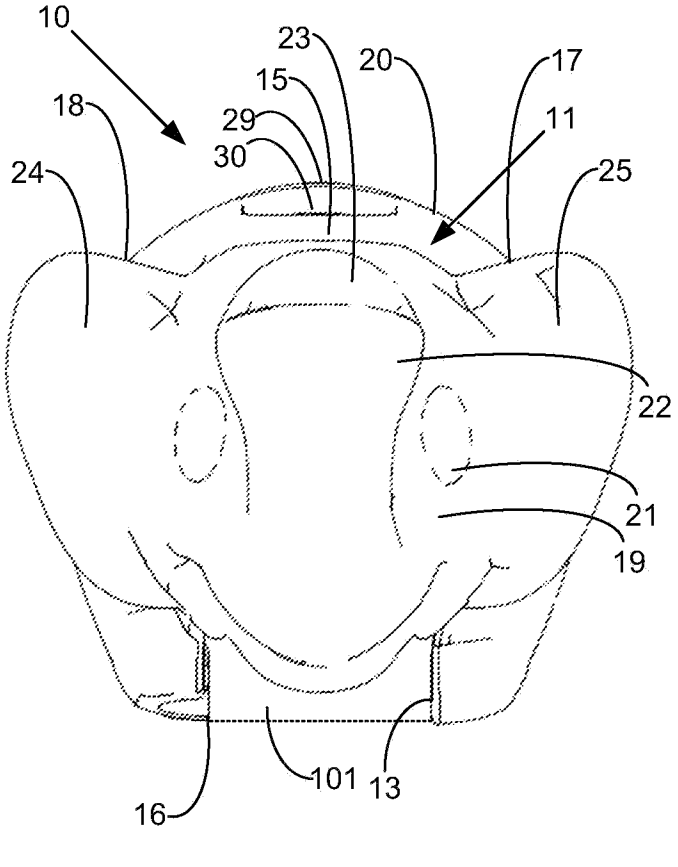
FIG. 2A illustrates a frontal view of a device in accordance with an exemplary embodiment of the disclosure.

FIGS. 2A-B provide a front view of an example embodiment illustrating a device 10 that includes a body 11 configured to at least partially surround or cover a plumbing fixture 100. In the embodiment shown, the body 11 includes an interior surface 13 that defines a cavity 101 which provides a space capable of accommodating at least a portion of plumbing fixtures of various sizes. The body 11 provides a top 15, a bottom 16, a right 17, a left 18, a front 19 and a back 20. The exterior of the body 11 has a decorative display. Here, the body 11 bears the appearance of an elephant including a front 19 with a design feature 21 such as an eye, a trunk 22 and an opening 23 in the trunk; a left 18 with an ear 24; a right 17 with an ear 25. The top 15 provides a first opening 29 and a second opening 30 that span less than half the width of the body. The first opening 29 may be positioned to accommodate a spout of the plumbing fixture. The second opening 30 may be positioned to accommodate a shower diverter on a topside of the plumbing fixture. The bottom 16 is open along the length and width of the device 10 providing an area to accommodate insertion of a plumbing fixture 100. Similarly, the back 20 is open along the width and height of the device 10.

Figure 3:
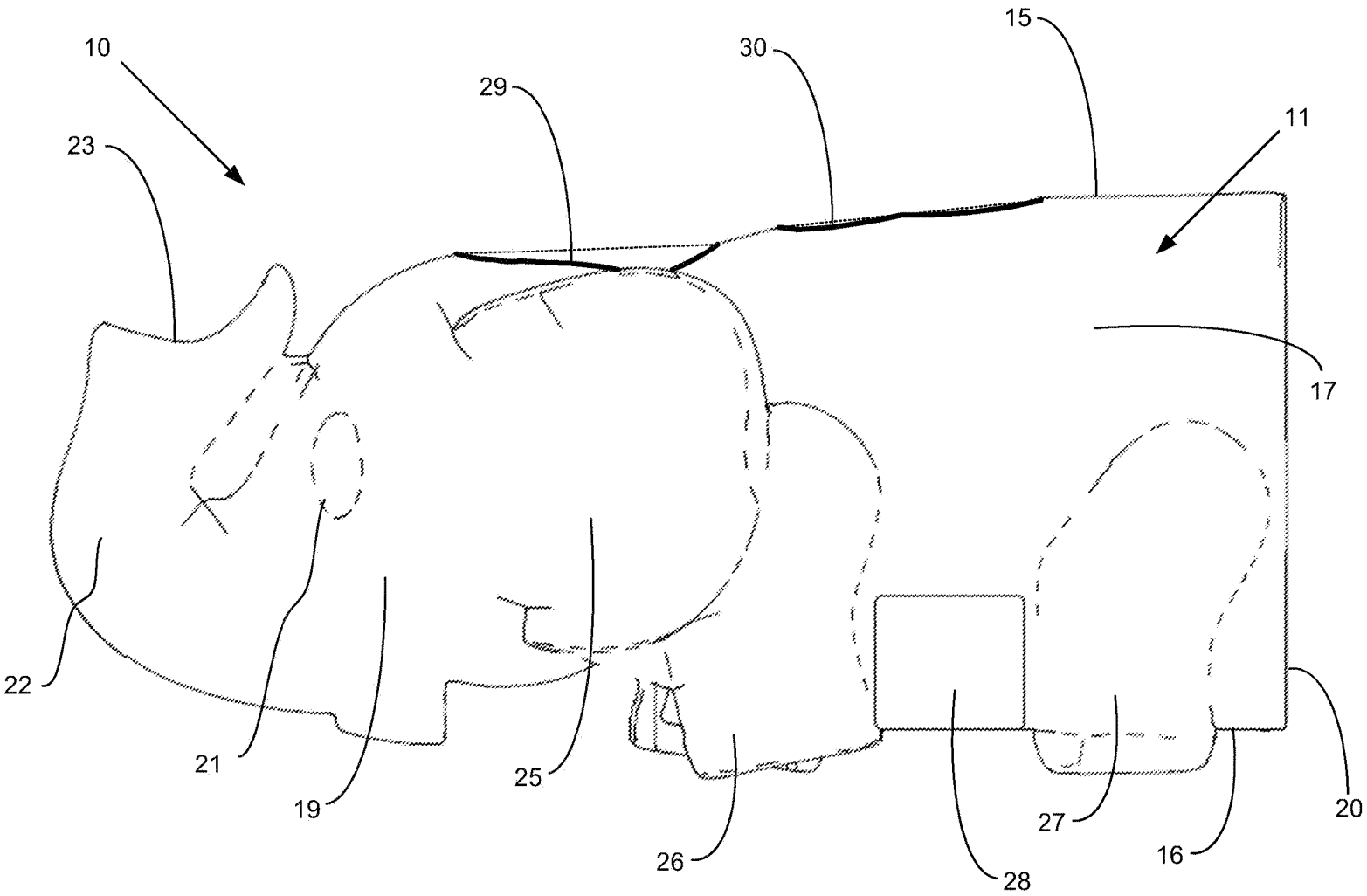
FIG. 3 illustrates a first side view of a device in accordance with an exemplary embodiment of the disclosure.

FIG. 3 provides a right-side view of an example embodiment illustrating a device 10 that includes a body 11 configured to surround or cover at least part of a plumbing fixture. In the embodiment shown, the body 11 bears the appearance of an elephant including a front 19 with design feature 21 such as an eye, a trunk 22 and an opening 23 in the trunk; a right 17 with an ear 25, two legs 26 and 27 and an area for a first flap 28; and a top 15 with the first opening 29 and the second opening 30 that extend less than half the length of the body. The area 28 for the first flap is situated near the bottom 16 on the right 17 and the first flap on the right provides an extension to engage part of the plumbing fixture. The bottom 16 is open, providing an area to accommodate inserting a plumbing fixture. Similarly, the back 20 is open. Together these open areas accommodate sliding the body 11 onto a plumbing fixture or pressing the body 11 against a plumbing fixture to cover part of the plumbing fixture.

Figure 4:
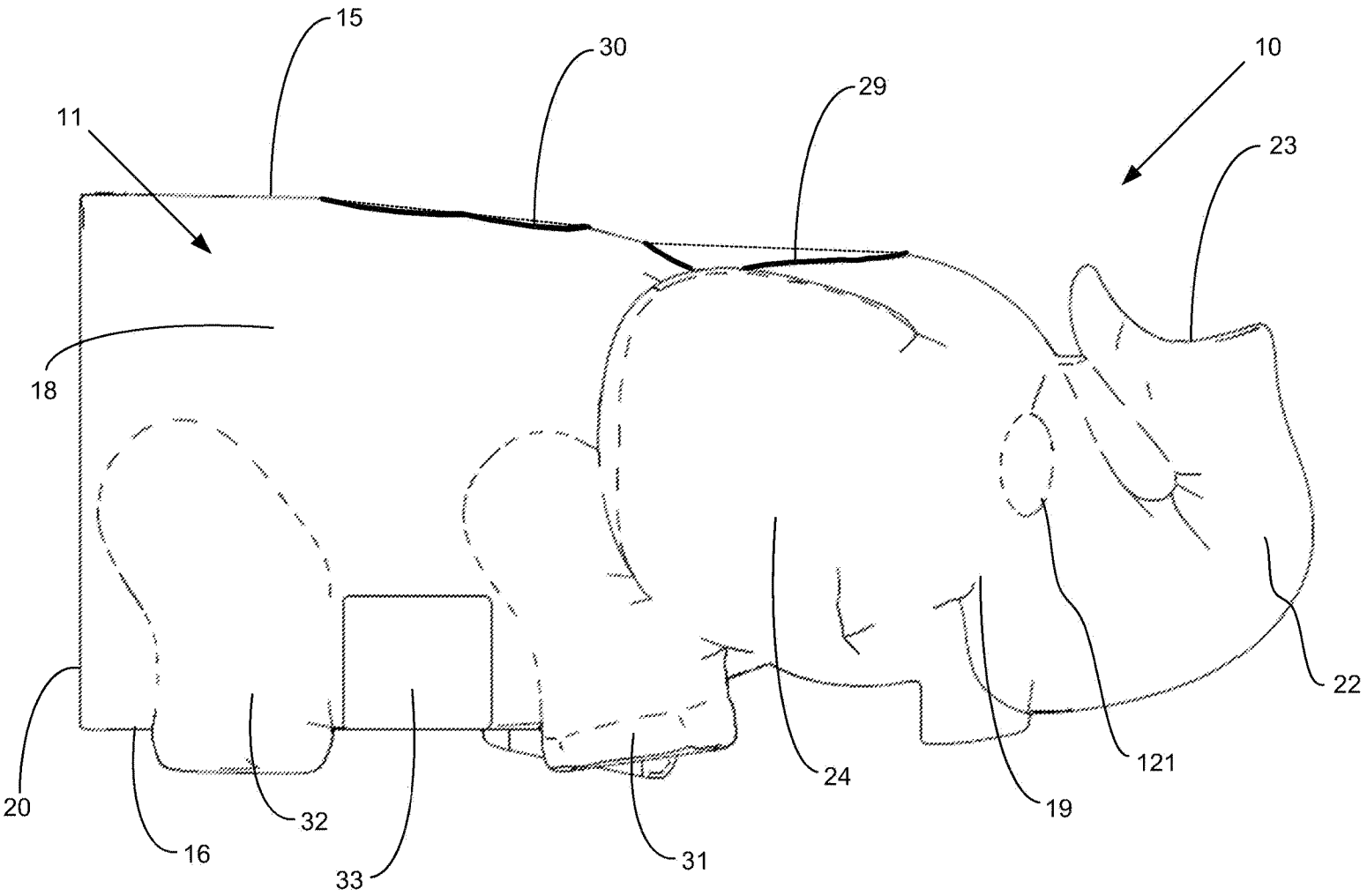
FIG. 4 illustrates a second side view of a device in accordance with an exemplary embodiment of the disclosure.

FIG. 4 provides a left-side view of an example embodiment illustrating a device 10 that includes a body 11 configured to surround or cover part of a plumbing fixture. In the embodiment shown, the body 11 bears the appearance of an elephant including a front 19 with a second design feature 121, a trunk 22 and an opening 23 in the trunk; a left 18 with an ear 24, two legs 31 and 32 and a second area 33 for a second flap; and a top 15 with a first opening 29 and a second opening 30 that extend less than half the length of the body 11. The second area 33 for the positioning mechanism is situated near the bottom 16 on the left 18 and the positioning mechanism on the left provides a second extension to engage part of the plumbing fixture. The bottom 16 is open, providing an area to accommodate inserting a plumbing fixture. Similarly, the back 20 is open.

Figure 5:
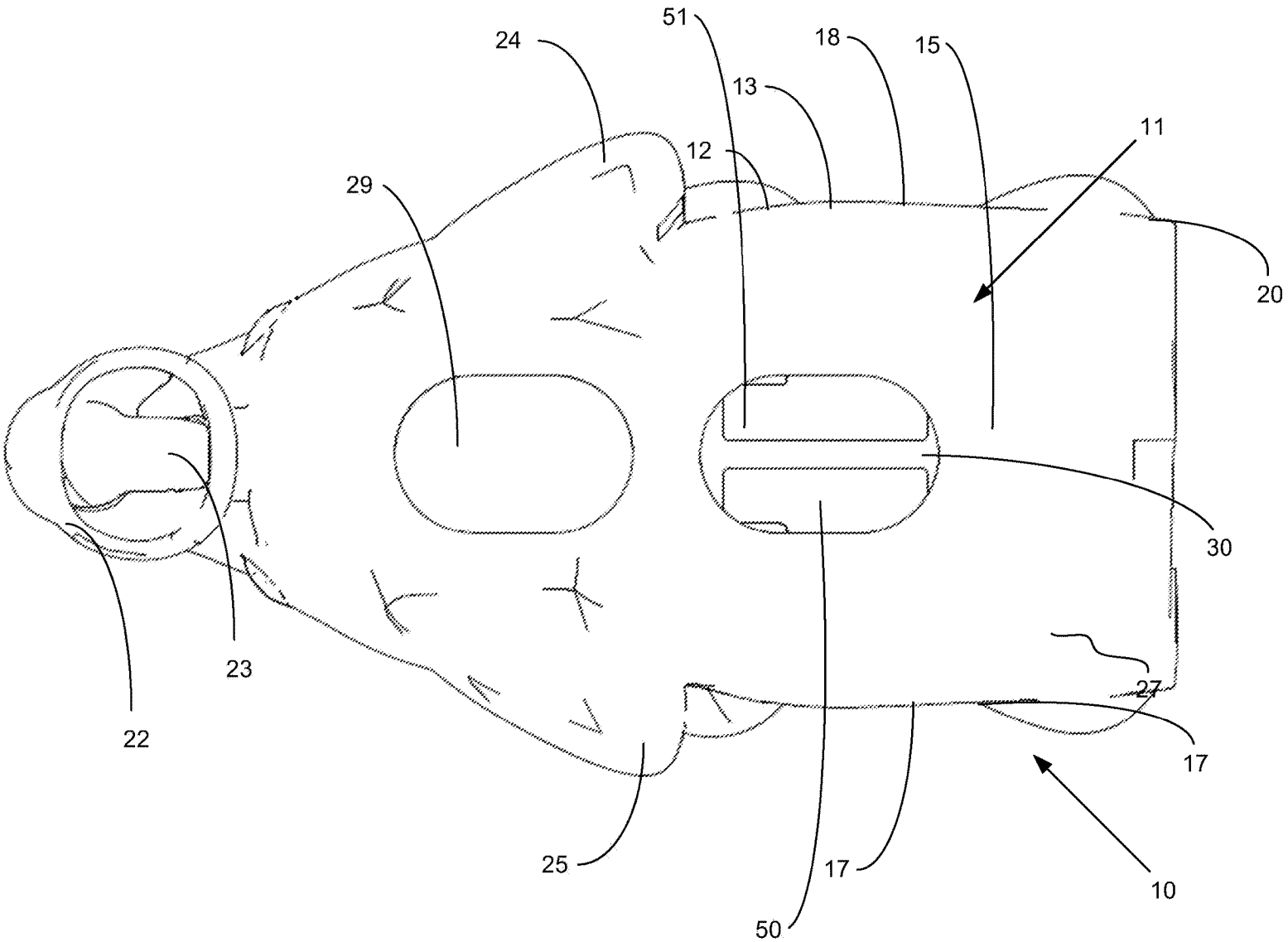
FIG. 5 illustrates a top view of a device in accordance with an exemplary embodiment of the disclosure.

FIG. 5 provides top view of an example embodiment illustrating a device 10 that includes a body 11 configured to surround or cover part of a plumbing fixture. In the embodiment shown, the device 10 includes a first flap 50 and a second flap 51 attached to the interior of the body. In alternative embodiments, the device 10 may include only a first flap 50 or only a second flap 51 to engage the plumbing fixture when the device 10 is in use. According to some embodiments, the first flap 50 and second flap 51 are attached to the interior of the body 11. In some embodiments, the first flap 50 and/or second flap 51 can include elongated portions which extend from the edge of the flaps up toward the front of the body. The body 11 provides a top 15 with a first opening 29 and a second opening 30 that extend less than half the length of the body. The body 11 bears the appearance of an elephant including a front 19 with a trunk 22 and an opening 23 in the trunk 22; a left 18 with an ear 24; a right 17 with an ear 25.

Figure 6:
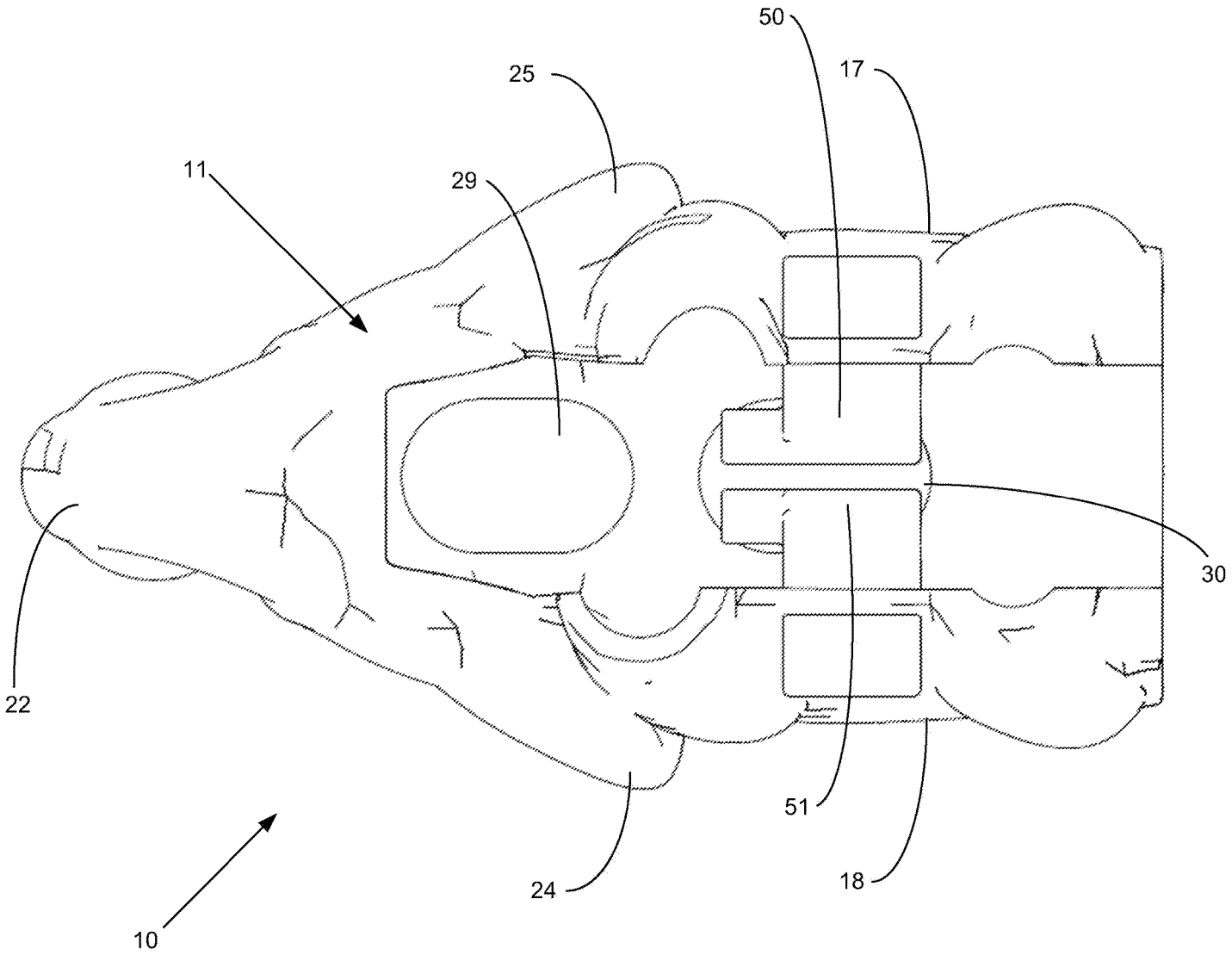
FIG. 6 illustrates a bottom view of a device in accordance with an exemplary embodiment of the disclosure.

FIG. 6 provides a bottom view of an example embodiment illustrating a device 10 that includes a body 11 configured to surround or cover part of a plumbing fixture. In the embodiment shown, the view displays the interior of the body 11 for an exemplary device 10 which includes the first flap 50 and a second flap 51 within a cavity on the interior of the body 11. The bottom is at least partially open along the width and length of the body 11 providing access to the top of the body 11 which provides two oval-shaped openings 29 and 30. The body bears the appearance of an elephant including a front 19 with a trunk 22; a left 18 with an ear 24; a right 17 with an ear 25.

Figure 7B:
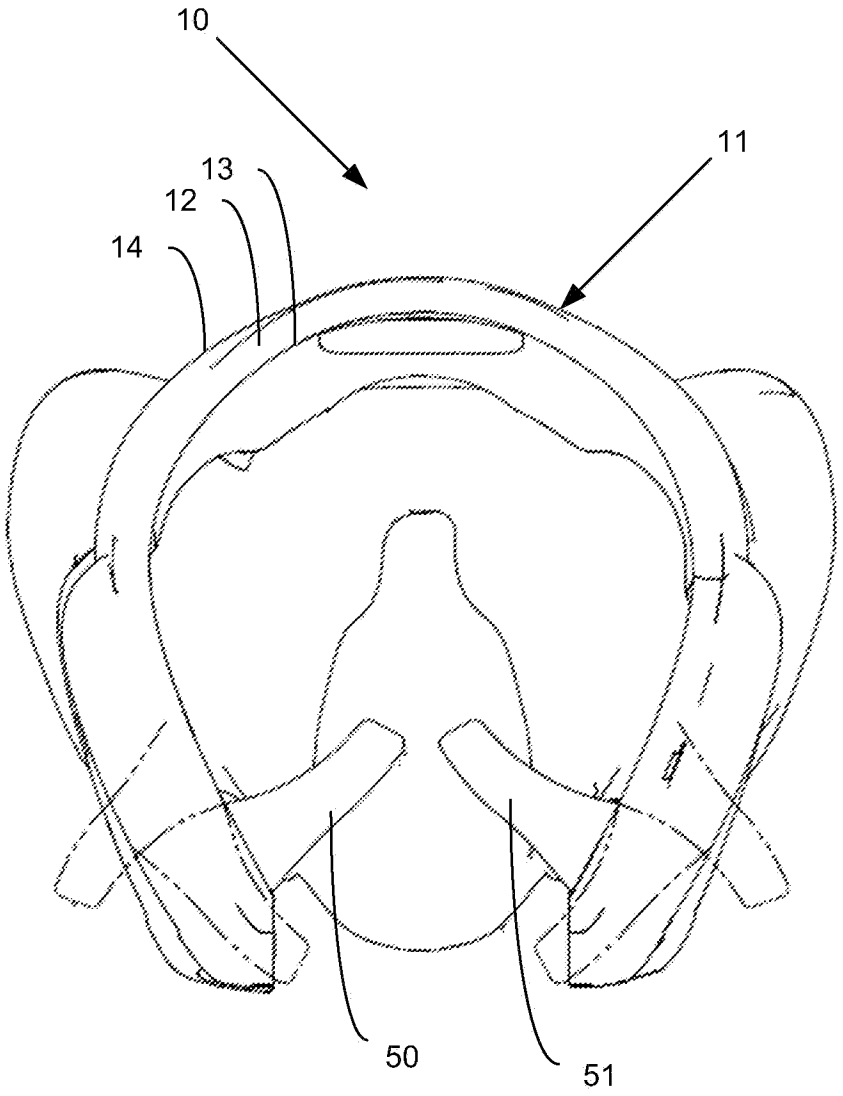
FIGS. 7A-B illustrate a rear view of a device in accordance with an exemplary embodiment of the disclosure.
Figure 7A:
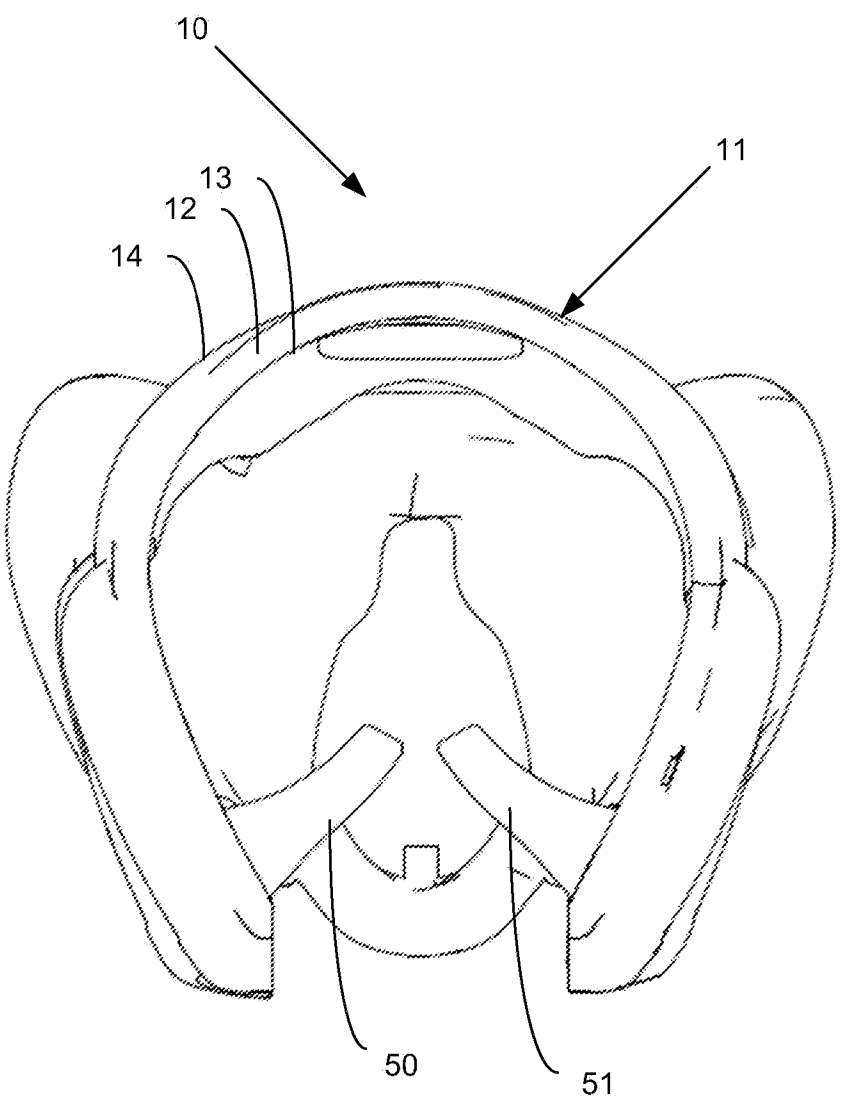

FIGS. 7A-B provide a rear view of an example embodiment illustrating a device 10 that includes a body 11 configured to surround or cover part of a plumbing fixture. In FIG. 7B, the dash-dot lines indicate possible positions of parts of the device. The body 11 provides a thickness 12 which describes the distance between an interior surface 13 of the body and an exterior surface 14 of the body. The body 11 is rigid enough to keep its shape when not in use, and flexible enough to adjust the positions of a right flap 50 and a left flap 51 within the body. In the embodiment shown, the first flap 50 and the second flap 51 are configured to flex away from each other while retaining the ability to return to their original position. In certain embodiments, the first flap 50 and the second flap 51 can be configured to flex toward one another, flex away from one another, and/or both. In some other embodiments, only the first flap 50 is configured to flex. In other embodiments, only the second flap 51 is configured to flex. The first flap 50 and the second flap 51 provide an interaction that allows the device to readily adapt to different sized plumbing fixtures. In certain embodiments, the first flap 50 and the second flap 51 are attached near the bottom of the body 11 on opposite sides and curve from the body 11, up into the space defined by the interior surface 13. In alternative embodiments, the device 10 may include additional flaps or an alternative positioning mechanism attached to the interior surface 13 of the body 11.

Figure 8:
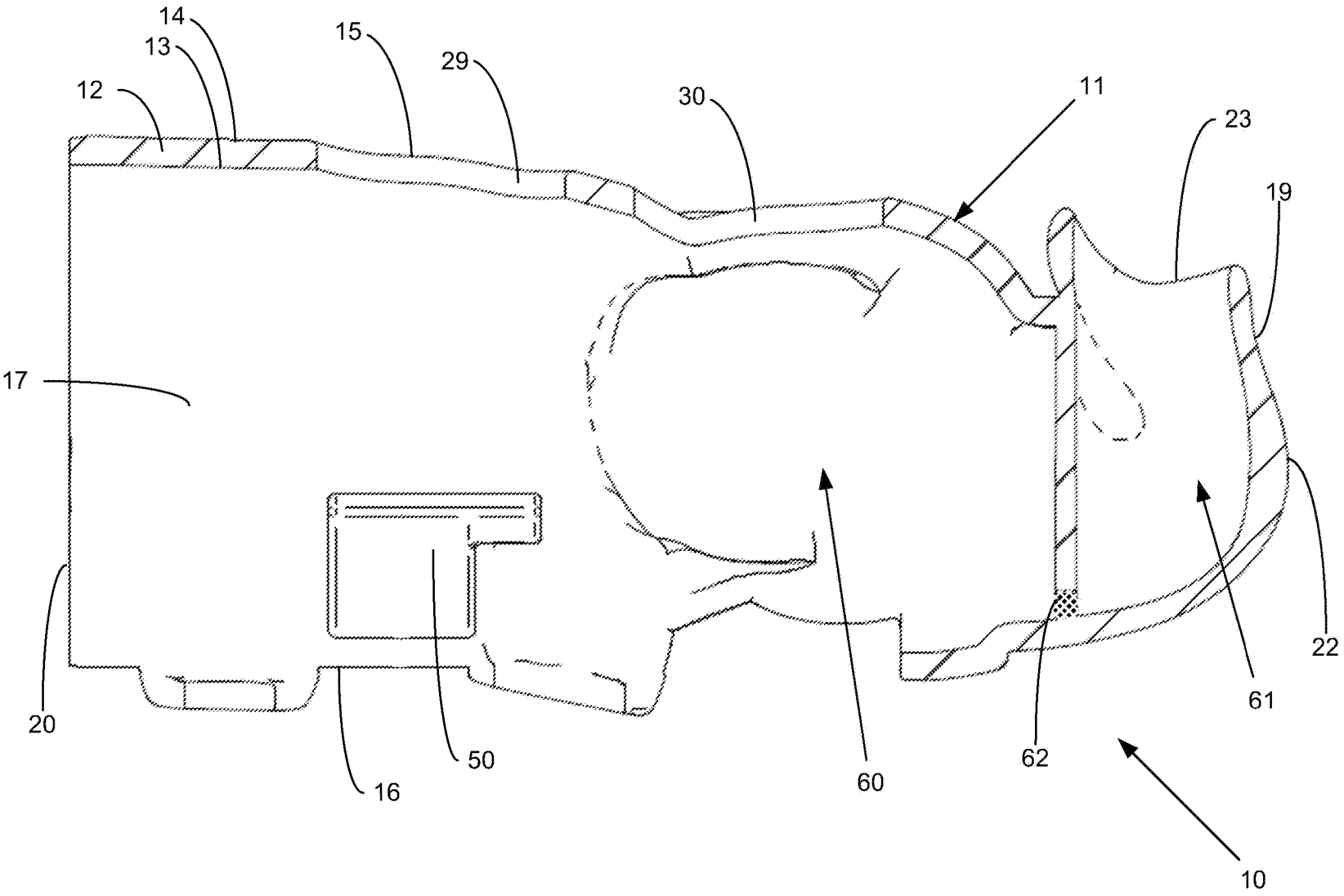
FIG. 8 illustrates a cross-section view for the second side of a device in accordance with an exemplary embodiment of the disclosure.

FIG. 8 provides a cross-section view of an example embodiment illustrating a right interior of a device 10 that includes a body 11 configured to surround or cover part of a plumbing fixture. The body 11 provides a thickness 12 which describes the distance between an interior surface 13 of the body 11 and an exterior surface 14 of the body 11. The body 11 displays a top 15, a bottom 16, a right 17, a front 19 and a back 20. In the embodiment shown, the body 11 bears the appearance of an elephant including a front 19 with, a trunk 22 and an opening 23 in the trunk 22. In the embodiment shown, the device 10 includes a first flap 50 protruding from the interior surface 13 at a position near the bottom 16 of the body 11. The first flap 50 extends up to an elongated portion which is lower than half the height of the body 11. In certain embodiments, the body 11 includes a space 60 and a trunk space 61 which may optionally be connected by a passage 62.

Figure 9:
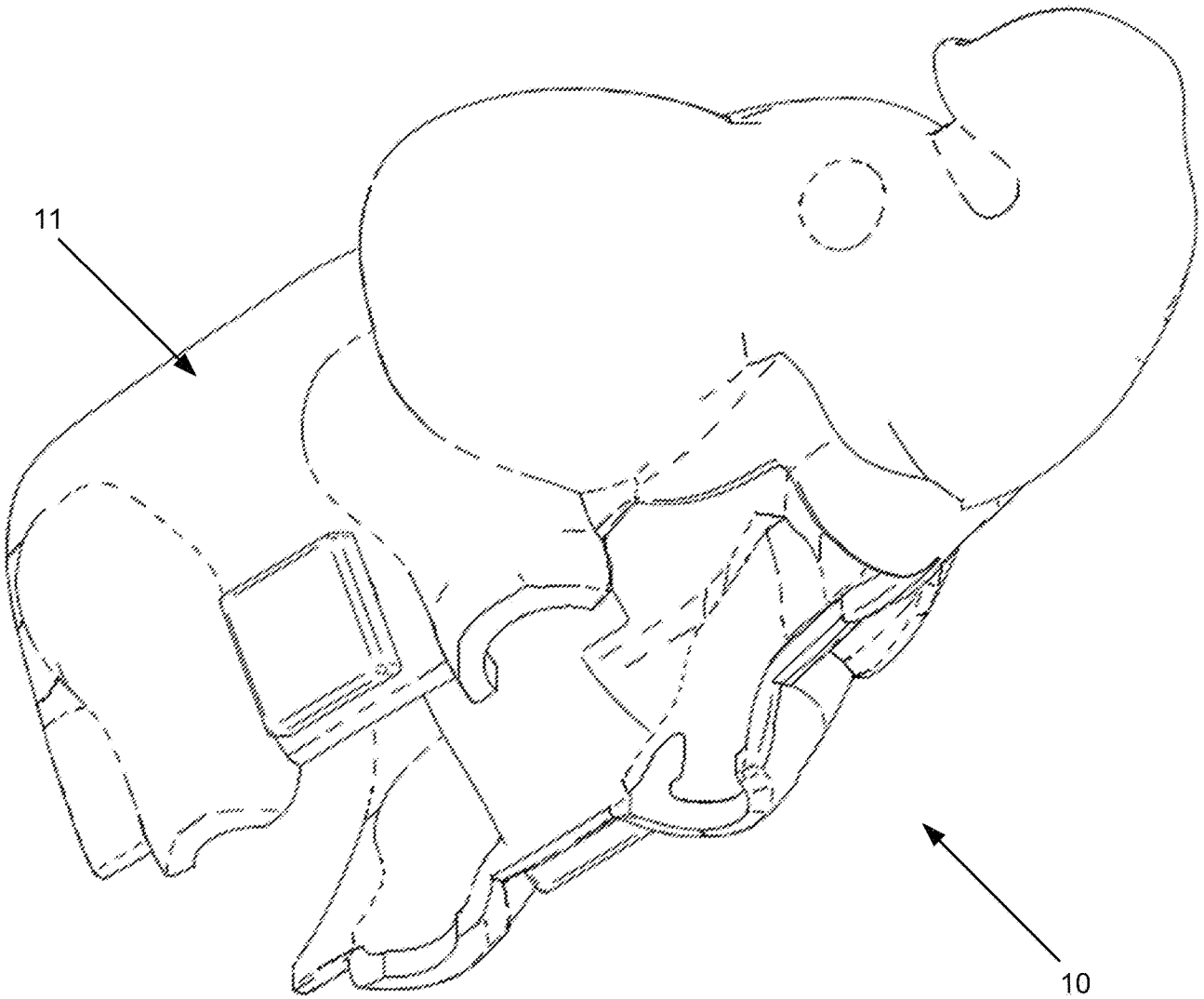
FIG. 9 illustrates a lower perspective view of a device in accordance with an exemplary embodiment of the disclosure.

FIG. 9 provides an example embodiment illustrating a device 10 that includes a body 11 configured to surround or cover part of a plumbing fixture. The embodiment shown demonstrates a device 10 assembled and surrounding a plumbing fixture.

In any prior embodiments, the device or components of the device may be described as flexible, elastic, or a combination of both. In certain embodiments, a positioning mechanism may be elastic, such that the shape of the positioning mechanism when distorted will return to its original form. In some embodiments, the positioning mechanism may be both flexible and elastic. In a preferred embodiment, the positioning mechanism will readily flex when the device is applied to a plumbing fixture such that the device is easily applied to the plumbing fixture. Further, in certain embodiments, the positioning mechanism will not readily flex when the device is removed from a plumbing fixture such that the device, though easily applied to a plumbing fixture provides additional resistance or friction when removing from a plumbing fixture. In any of these embodiments, it is contemplated that the device may include additional openings along the top of the device that would be capable of accommodating a feature on a plumbing fixture, such as a shower diverter.

In this description, numerous specific details have been set forth. It is to be understood, however, that implementations of the disclosed technology may be practiced without these specific details. In other instances, well-known methods, structures and techniques have not been shown in detail in order not to obscure an understanding of this description. References to "one embodiment," "an embodiment," "some embodiments," "example embodiment," "various embodiments," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "connected" means that one function, feature, structure, or characteristic is directly joined to or in communication with another function, feature, structure, or characteristic. The term "coupled" means that one function, feature, structure, or characteristic is directly or indirectly joined to or in communication with another function, feature, structure, or characteristic. The term "or" is intended to mean an inclusive "or." Further, the terms "a," "an," and "the" are intended to mean one or more unless specified otherwise or clear from the context to be directed to a singular form. By "comprising" or "containing" or "including" is meant that at least the named element, or method step is present in article or method, but does not exclude the presence of other elements or method steps, even if the other such elements or method steps have the same function as what is named.

While certain embodiments of this disclosure have been described in connection with what is presently considered to be the most practical and various embodiments, it is to be understood that this disclosure is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the technology and also to enable any person skilled in the art to practice certain embodiments of this technology, including making and using any apparatuses or systems and performing any incorporated methods. The patentable scope of certain embodiments of the technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

I claim:

1. A device comprising:

a body comprising:

an interior; and an exterior;

wherein the interior of the body defines a space configured to accommodate at least a portion of a plumbing fixture; and wherein the exterior of the body forms a decorative display; and a first flap affixed to the interior of the body and configured to:

flex outwardly when fitting the device to a plumbing fixture; and flex inwardly when the device is flexibly secured to a plumbing fixture.

2. The device of claim 1 further comprising a second flap affixed to the interior of the body and configured to:

flex outwardly when fitting the device to a plumbing fixture; and flex inwardly when the device is flexibly secured to a plumbing fixture.

3. The device of claim 2, wherein the first and second flaps are positioned on opposite sides of the device.

4. The device of claim 2, wherein a width of the first flap and a width of the second flap are each less than half a width of the body.

5. The device of claim 1, wherein the first flap extends to a terminal end; and wherein upon the device being fitted and then flexibly secured to a plumbing fixture, the terminal end of the first flap is free from contact with the body.

6. The device of claim 2, wherein the first flap extends to a terminal end;

wherein the second flap extends to a terminal end; and wherein upon the device being fitted and then flexibly secured to a plumbing fixture, the terminal ends of each of the first and second flaps are free from contact with the body.

7. The device of claim 1, wherein the body is flexible; and wherein a mechanism of flexibly securing the device to a plumbing fixture consists of the flexibility of the body and the flexibility of the first flap.

8. The device of claim 2, wherein the body is flexible; and wherein a mechanism of flexibly securing the device to a plumbing fixture consists of the flexibility of the body, the flexibility of the first flap, and the flexibility of the second flap.

9. The device of claim 1, wherein the first flap is further configured to engage an underside of a plumbing fixture.

10. The device of claim 1, wherein the body further comprises two discrete, unconnected openings, a first opening positioned to accommodate a spout of a plumbing fixture, and a second opening positioned to accommodate a shower diverter on a topside of a plumbing fixture.

11. The device of claim 1, wherein the body and first flap comprise a material selected from the group consisting of an elastomer, a resin, a gel, a copolymer, and a thermoplastic.

12. A device comprising:

a flexible body comprising:

an interior configured to house at least a portion of a plumbing fixture;

an exterior forming a decorative display, and two discrete, unconnected openings disposed on a top portion of the body, a first opening positioned to accommodate a spout of a plumbing fixture, and a second opening positioned to accommodate a shower diverter on a topside of a plumbing fixture; and a first flap curving inwardly from a first side of the device toward the interior and configured to:

flex outwardly when fitting the device to at least a portion of a plumbing fixture; and flex inwardly when the device is flexibly secured to at least a portion of a plumbing fixture;

wherein the first flap extends to a terminal end; and wherein upon the device being fitted and then flexibly secured to a plumbing fixture, the terminal end of the first flap is free from contact with the body.

13. The device of claim 12 further comprising a second flap curving inwardly from a second side of the device toward the interior and configured to:

flex outwardly when fitting the device to at least a portion of a plumbing fixture; and flex inwardly when the device is flexibly secured to at least a portion of a plumbing fixture;

wherein the second flap extends to a terminal end; and wherein upon the device being fitted and then flexibly secured to a plumbing fixture, the terminal end of the second flap is free from contact with the body.

14. The device of claim 13, wherein the first and second flaps are positioned on opposite sides of the device.

15. The device of claim 12, wherein the flexible body is elastic.

16. The device of claim 13, wherein the flexible body, first flap and second flap each comprise a material selected from the group consisting of an elastomer, a resin, a gel, a copolymer, and a thermoplastic.

17. A device comprising:

a flexible body comprising:

a polymer selected from the group consisting of an elastomer, a resin, a gel, a copolymer, and a thermoplastic;

an interior configured to house at least a portion of a plumbing fixture;

an exterior forming a decorative display; and a first opening positioned to accommodate a spout of a plumbing fixture; and a mechanism of flexibly securing the device to a plumbing fixture consisting of:

the flexibility of the body;

a first flap configured to:

flex outwardly when fitting the device to at least a portion of a plumbing fixture; and flex inwardly when the device is flexibly secured to at least a portion of a plumbing fixture; and a second flap configured to:

flex outwardly when fitting the device to at least a portion of a plumbing fixture; and flex inwardly when the device is flexibly secured to at least a portion of a plumbing fixture.

18. The device of claim 17 further comprising a second opening positioned to accommodate a shower diverter on a topside of a plumbing fixture.

* * * * *